US007118334B2

(12) United States Patent
Winkler et al.

(10) Patent No.: US 7,118,334 B2
(45) Date of Patent: Oct. 10, 2006

(54) FAN AND FASTENING ELEMENT AND METHOD OF ASSEMBLING

(75) Inventors: Wolfgang Arno Winkler, St. Georgen (DE); Nils Rapp, St. Georgen (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 190 days.

(21) Appl. No.: 10/971,648

(22) Filed: Oct. 20, 2004

(65) Prior Publication Data

US 2005/0084369 A1 Apr. 21, 2005

(30) Foreign Application Priority Data

Oct. 21, 2003 (DE) ..... 103 49 643

(51) Int. Cl.
*F03D 11/04* (2006.01)
*F03B 11/02* (2006.01)

(52) U.S. Cl. ..... 415/213.1; 415/214.1; 165/80.1

(58) Field of Classification Search ..... 415/213.1, 415/214.1, 126, 127; 165/80.1, 80.2; 361/694, 361/695

See application file for complete search history.

(56) References Cited

U.S. PATENT DOCUMENTS

| | | | | |
|---|---|---|---|---|
| 5,924,849 | A | 7/1999 | Kirchgessner et al. | 417/423.15 |
| 6,017,185 | A | 1/2000 | Kuo | 415/177 |
| 6,021,043 | A | 2/2000 | Horng | 361/695 |
| 6,320,291 | B1 | 11/2001 | Lin et al. | 310/91 |
| 6,334,750 | B1 | 1/2002 | Hsieh | 411/508 |

FOREIGN PATENT DOCUMENTS

| | | |
|---|---|---|
| DE | 295 01 495 U1 | 3/1995 |
| DE | 297 12 967 U1 | 9/1998 |
| DE | 298 10 924 U1 | 9/1998 |
| DE | 101 09 621 | 9/2002 |
| DE | 202 19 814 U1 | 3/2003 |
| WO | WO 00/36304 | 6/2000 |

*Primary Examiner*—Edward K. Look
*Assistant Examiner*—Dwayne J White
(74) *Attorney, Agent, or Firm*—Milton Oliver, Esq.; Ware Fressola Van Der Sluys & Adolphson LLP

(57) ABSTRACT

An improved structure and method for mounting a fan, particularly a miniature fan (3), in a supporting wall (4), both facilitates a mounting operation and minimizes noise conduction after the mounting operation. An elastomeric overcoat (1) at least partially surrounds the fan (3) and is preferably integrally formed with a plurality of mushroom-shaped mounting elements (7) adapted to engage in a corresponding plurality of mounting holes (41) formed in the supporting wall (4). Each mounting element has a shaft portion (71) and a head portion (72) with an internal channel (74) starting in the shaft portion (71) and ending in the head portion (72). Rapid mounting of the fan (3) to the wall (4) can be accomplished by inserting a respective tool (10) into the channel (74) of each mounting element (7), to elongate the mounting element and reduce its diameter, passing the elongated mounting element into its mounting hole (41), and withdrawing the tool, permitting elastic relaxation of the mounting element to restore its original diameter, thereby forming a secure, vibration-damping engagement with the periphery of the mounting hole.

15 Claims, 5 Drawing Sheets

FAN AND FASTENING ELEMENT AND METHOD OF ASSEMBLING

FIELD OF THE INVENTION

The present invention generally relates to a fan with a fastening or mounting element, and to a method of assembling such a fan with a supporting structure.

BACKGROUND

Mini-fans, also called small or miniature fans, serve, for example, for cooling of processors in computed, and for device cooling in small devices, and they have very small dimensions. For example, the fans of the ebm-papst series 250 have dimensions of 8×25×25 mm;

the ebm-papst series 400F have dimensions of 10×40×40 mm;

the ebm-papst series 400 have dimensions of 20×40×40 mm;

the ebm-papst series 600 have dimensions of 25.4×60×60 mm.

The power consumption of such fans falls in respective ranges: for series 250, between 0.4 and 0.6 watts;

for series 400F, between 0.7 and 0.9 watts; and for series 400 and 600, between 0.9 and 1.6 watts.

With mini-fans, it is customary to secure them using screws or rivets. However, this has the disadvantage that such fasteners can transmit structure-borne noise and vibrations, which are transferred from the fan into a support structure supporting the fan. This kind of resonance amplifies the noise. Furthermore, the conventional manner of fastening is costly, since it requires multiple positioning and securing steps.

SUMMARY OF THE INVENTION

It is therefore an object of the invention to provide a novel fan, and a method of mounting or assembling it.

This object is achieved by a fan structure in which at least one mounting element, adapted for insertion into a corresponding mounting hole of a support structure, has a longitudinal channel open at one end, and a method of assembling a fan and a support structure together, according to which a bulbous elastomeric mounting element is temporarily elongated and narrowed, by inserting a rod therein, in order to slip into a mounting hole, withdrawal of the rod making the mounting element bulbous again, so that it form-locks within the mounting hole. This facilitates a simple and time conserving mounting of such a small fan.

Further, the use of elastomeric mounting elements dampens vibrations which would otherwise be transmitted from the fan to its support structure.

Preferably, the fan is a small or miniature fan, which can be configured as an axial fan, a diagonal fan or a radial fan.

BRIEF FIGURE DESCRIPTION

Further details and advantageous refinements of the invention will be apparent from the following description and the accompanying drawings of exemplary embodiments, which are not to be construed as limiting the invention:

DETAILED DESCRIPTION

Figure 1:
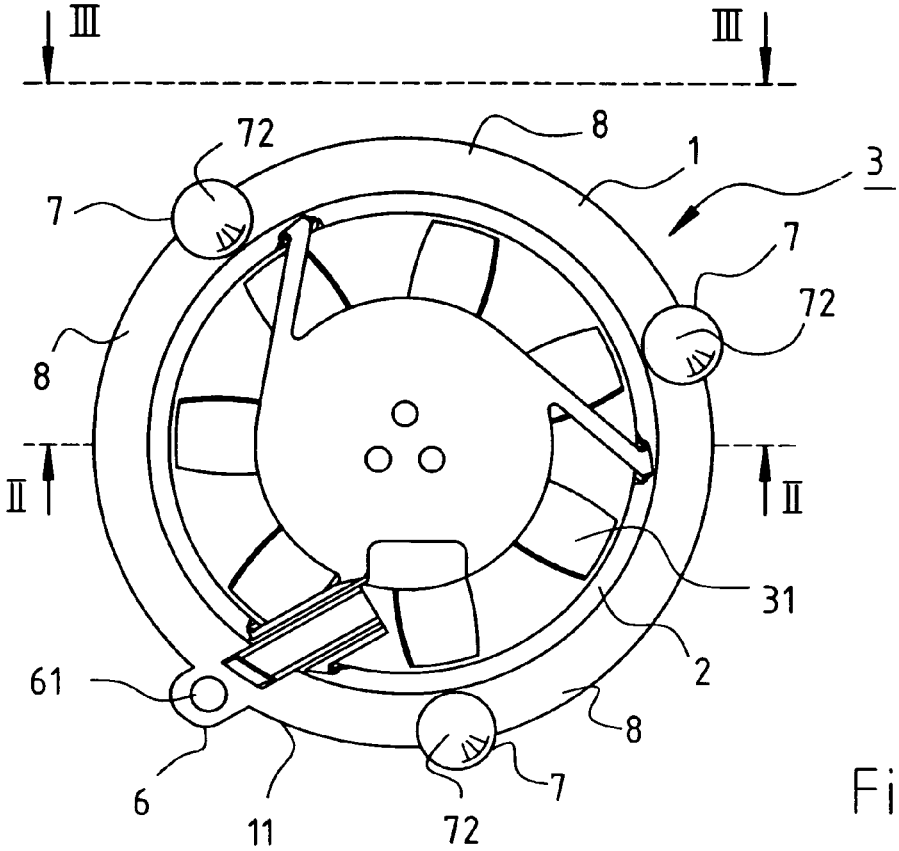
FIG. 1 is a plan view of a fan according to the invention.

In the following description, equivalent or functionally equivalent parts are designated with the same reference numerals, and are usually described only once.

FIG. 1 shows a mini-fan 3 having a fan wheel 31. Fan 3 has an outer housing 2, within which fan wheel 31 rotates and, on the periphery of housing 2, there is provided, as shown, a coating 1 of an elastomeric material. The housing 2 is surrounded by this elastomeric coating 1, including projecting corners 8 thereof and the elastically deformable coating 1 is held force-lockingly and force-lockingly on outer housing 2 by light streching or tensioning.

For its mounting, mini-fan 3 is equipped with mounting elements 7, which are preferably integrally formed with the elastic coating 1. These mounting elements 7 are generally mushroom-shaped, each with a head portion 72, are essentially identically formed, and are preferably spaced from each other by the same angular interval or distance. The head portions 72 point in the same direction. FIG. 1 illustrates, as an example, the use of three mounting elements 7.

At the periphery 17 of elastic coating 1, there is formed a strain relief 6 for a connecting cable (not shown) of mini-fan 3. The strain relief 6 is formed with an eyelet 61, through which the connecting cable is threaded or placed.

Figure 2:
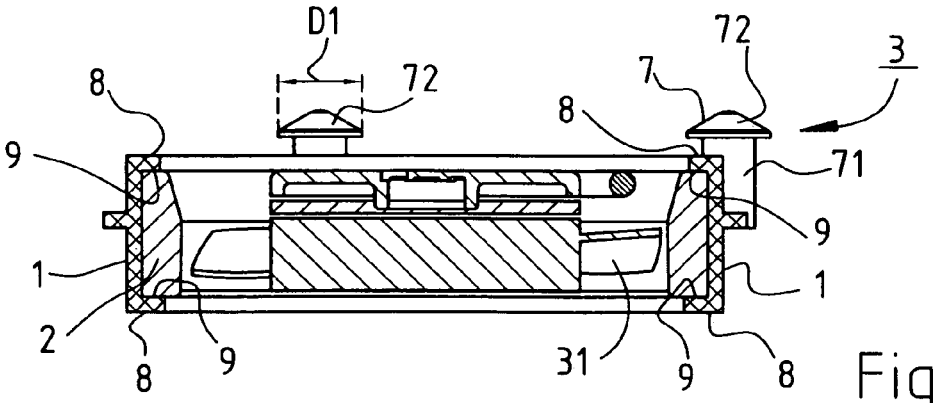
FIG. 2 is a sectional view, looking along line II—II of FIG. 1.

FIG. 2 is a section through the mini-fan 3 of FIG. 1. Extensions 8 of elastic coating 1 extend over the outer corners 9 of housing 2. For insertion of mini-fan 3 into the elastic coating 1, the latter is preferably stretched, so that the mini-fan can be placed inside. Thereafter, the stretching of the coating is released, so that it rests, with tension, around mini-fan 3. Alternatively, the coating can be vulcanized onto the outer housing.

The elastic material of coating 1 and of the mounting elements 7 dampens noises and vibrations that arise during running of mini-fan 3.

As a material for coating 1 and for mounting elements 7, one can use rubber, an elastomer, cellular or foamed materials, or other materials with similar elasticity characteristics.

Figure 12:
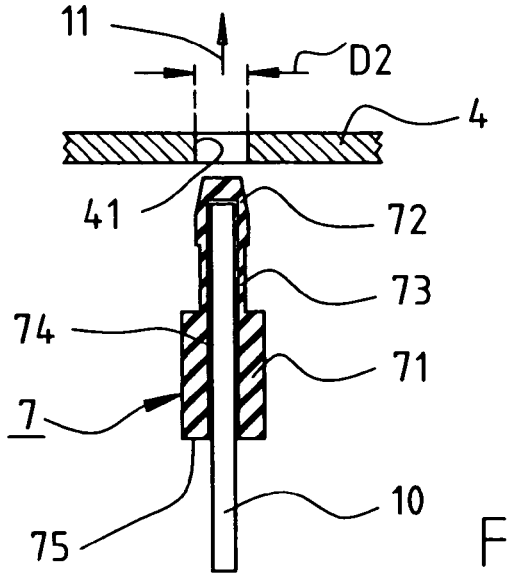
FIG. 12 shows one step of an inventive method, in which a mounting element of the fan is elastically deformed by a rod 10.
Figure 13:
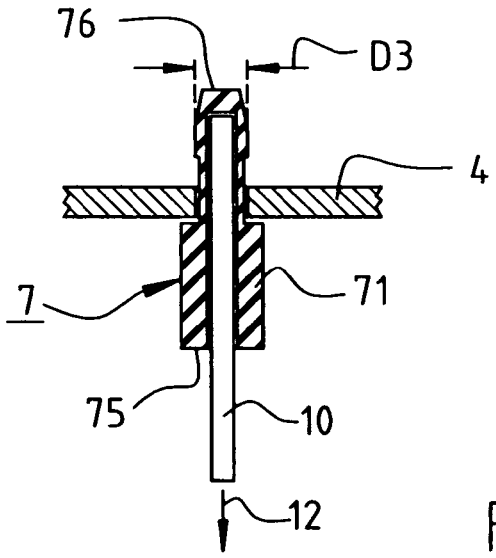
FIG. 13 shows another step of an inventive method, in which the elastically deformed mounting element is inserted into a mounting hole.
Figure 14:
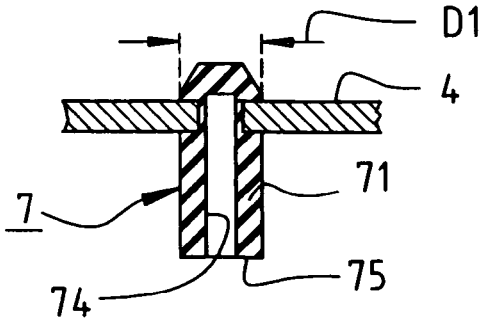
FIG. 14 shows still another step of an inventive method, in which the mounting element form-locks to a support structure.

Holding of mini-fan 3 on a support structure 4 (FIG. 4), e.g. a wall, is achieved using the mounting elements 7. As shown in FIG. 12 through 14, these each have a shaft portion 71 and a head portion 72, between which there is preferably a constriction 73. The head portions 72 each engage and cooperate with a respective mounting opening 41 formed in support structure 4, in such a way that the elastic coating 1 and the housing 2 are secured on mounting wall 4, preferably form-lockingly and with elastic contact pressure. This is explained below, with reference to FIGS. 4–11.

Figure 3:
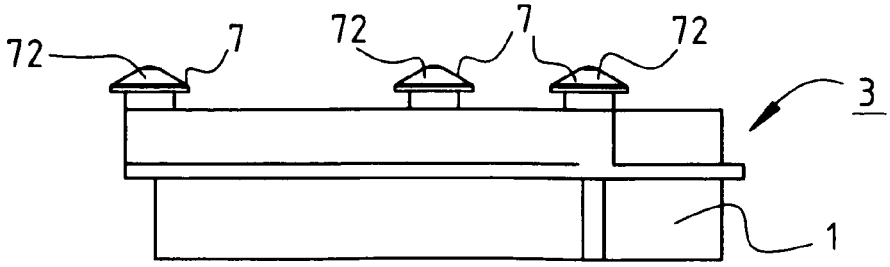
FIG. 3 is a side view of the fan of FIG. 1, looking along direction III of FIG. 1.

FIG. 3 is a side view of the elastic coating 1, looking in the direction of arrow III—III of FIG. 1.

Figure 4:
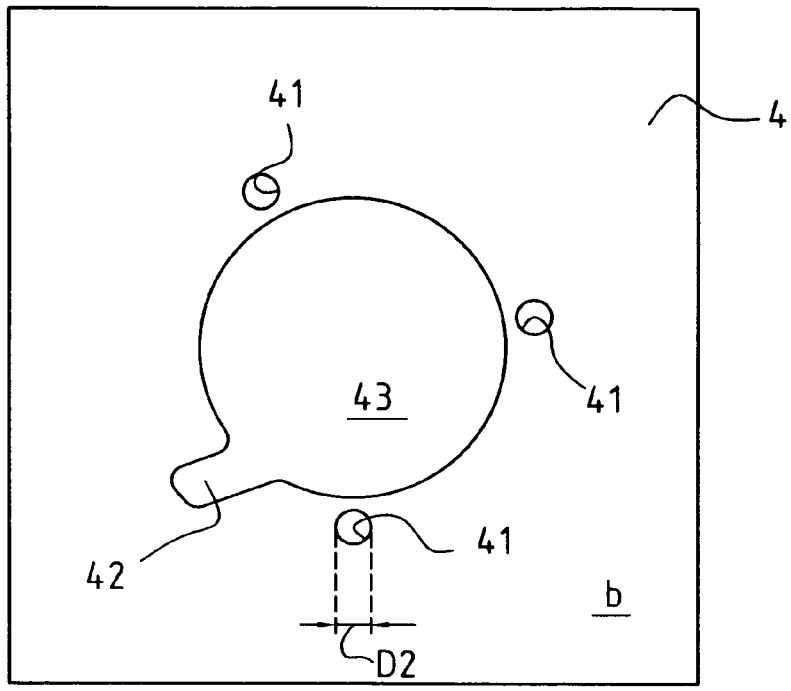
FIG. 4 is a plan view of a wall formed with openings for mounting of a fan according to FIGS. 1–3.

FIG. 4 shows a wall 4 having an aperture 43, at which a mini-fan 3 can be mounted, in a very simple manner, by means of its mounting elements 7. For this purpose, mounting holes 41 are provided in this wall 4, and these cooperate, during the mounting operation, with the mounting elements 7. The mounting holes 41 have a diameter D2 which is preferably less than the diameter D1 of the mushroom-shaped head portions 72, shown in FIG. 2.

Extending from the main aperture 43, there is, as shown in FIG. 4, a notch 42, which serves for feed-through of a connecting cable and for receiving a strain relief 6, 61.

Figure 5:
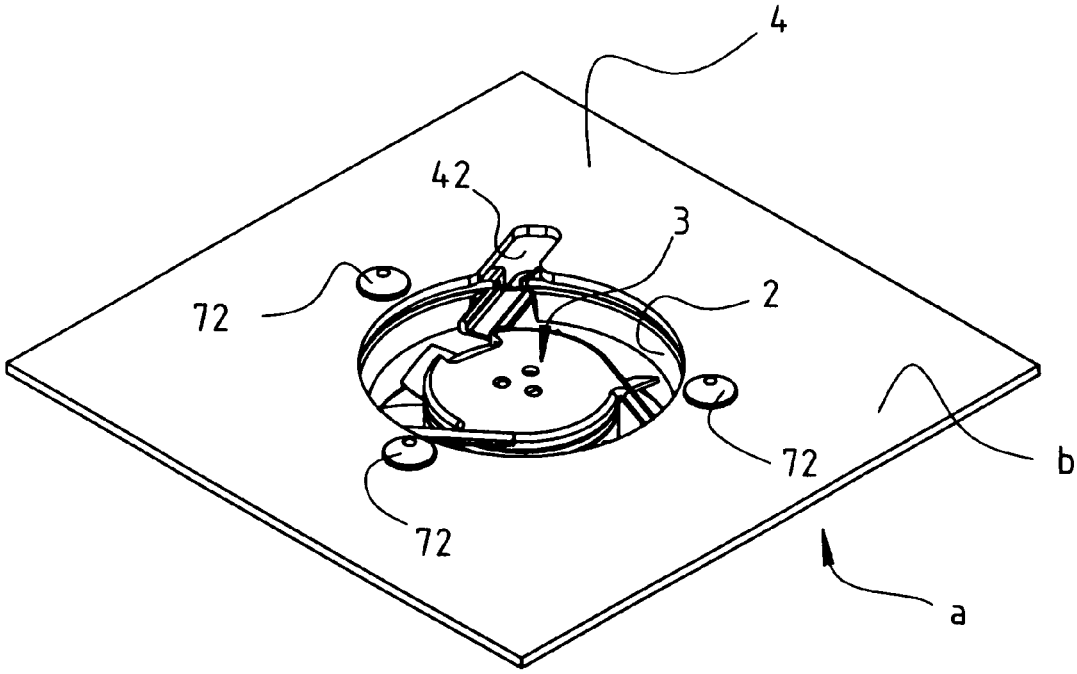
FIG. 5 is a perspective view of a mini-fan, mounted on a support structure in accordance with FIG. 4.

FIG. 5 is a perspective view, looking diagonally toward the mounting side "a", the opposing side "b" and a thus-mounted mini-fan 3. The mushroom-shaped head portions 72 project out over the mounting holes 41 and cover these.

Figure 6:
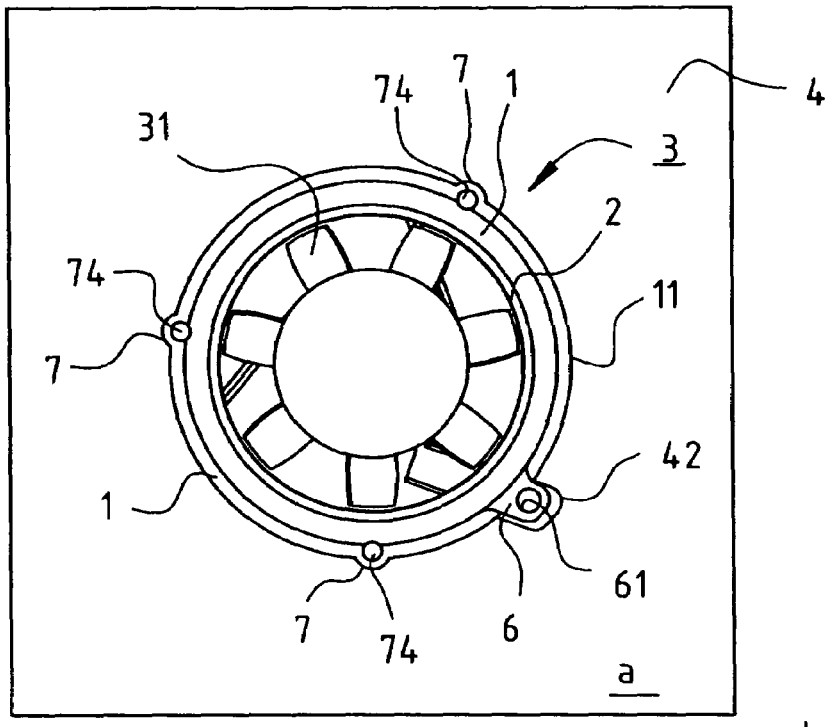
FIG. 6 is a plan view of the arrangement of FIG. 5, seen from the side of the wall on which the fan is mounted.

FIG. 6 is a plan view of mounting side "a" of support structure 4, i.e. the side on which fan 3 is mounted. In this view, respective channels 74 can be seen, which are arranged centrally in the respective mounting elements 7, and serve to assist assembly of mounting elements 7 into wall 4, as explained below with reference to FIGS. 12–14.

Figure 7:
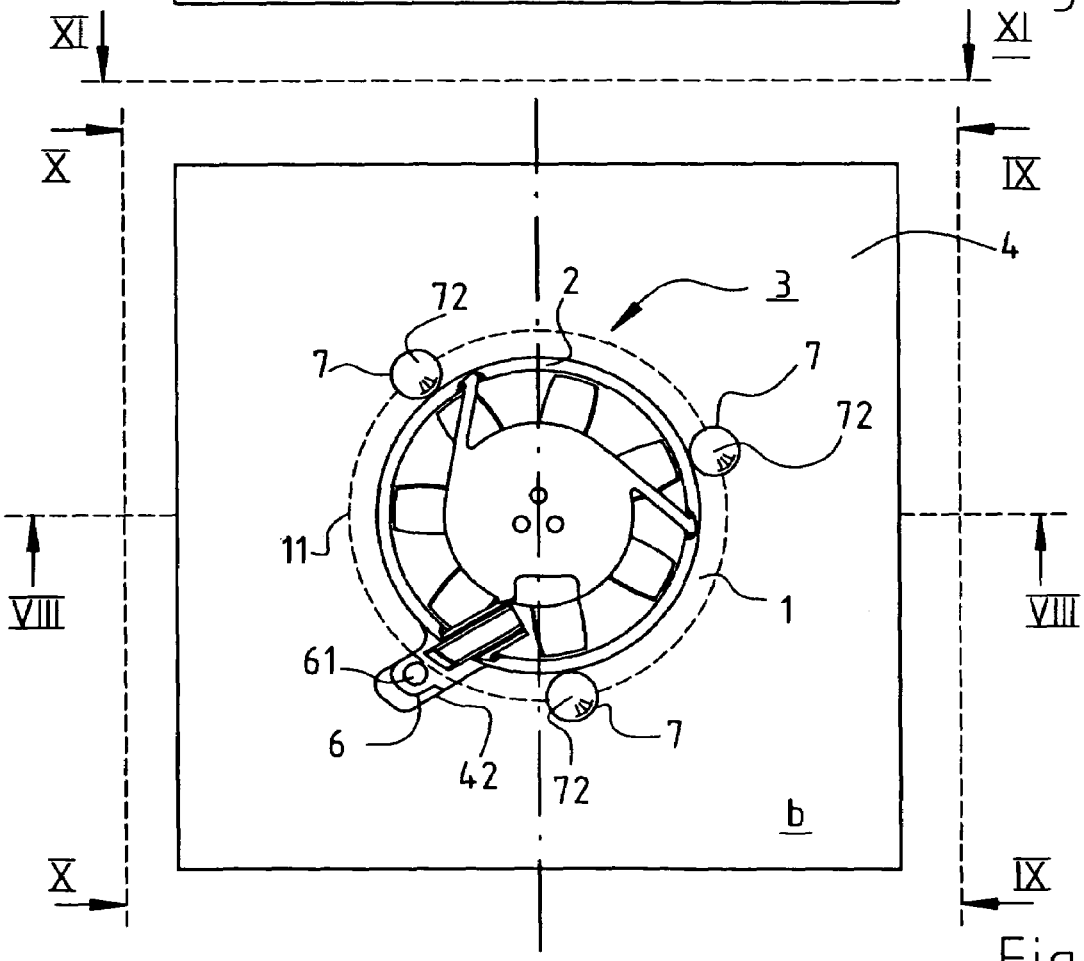
FIG. 7 is a view similar to that of FIG. 6, but seen from the opposite, mounting-remote side of the wall.

FIG. 7 is a plan view of side "b" of support structure 4, which is opposite to the other mounting side "a".

Figure 8:
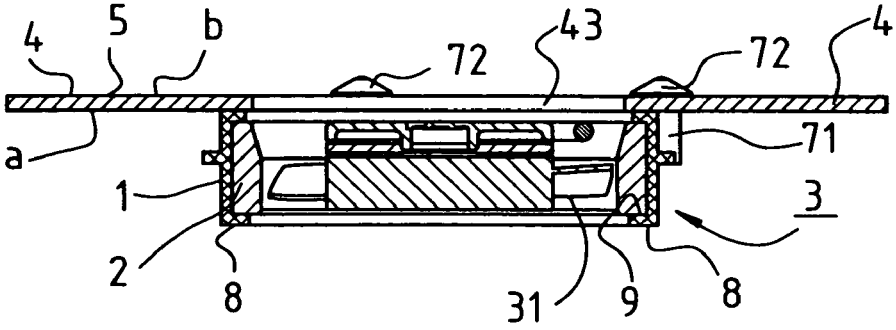
FIG. 8 is a sectional view, looking along line VII—VII of FIG. 7.

FIG. 8 is a section, similar to FIG. 2, through wall 4 and a mini-fan 3 mounted Hereon. The only parts which are in contact with wall 4, are parts of the elastomeric coating 1. This minimizes or eliminates the transmission of vibrations and noises from mini-fan 3 to wall 4, and one also obtains good sealing at the fan-wall interface.

Figure 9:
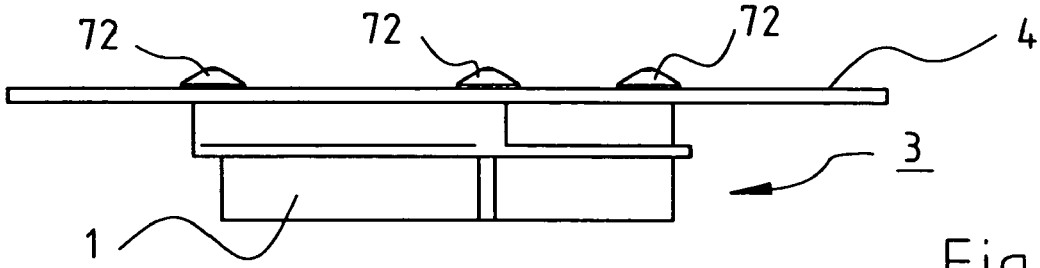
FIG. 9 is a side view of the fan, looking along direction IX of FIG. 7.

FIG. 9 is a side view of the mounted fan 3 and of its elastomeric coating 1.

Figure 10:
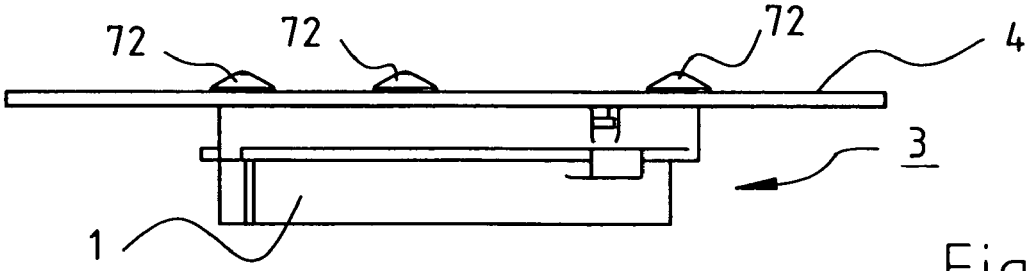
FIG. 10 is a side view of the fan, looking along direction X of FIG. 7.
Figure 11:
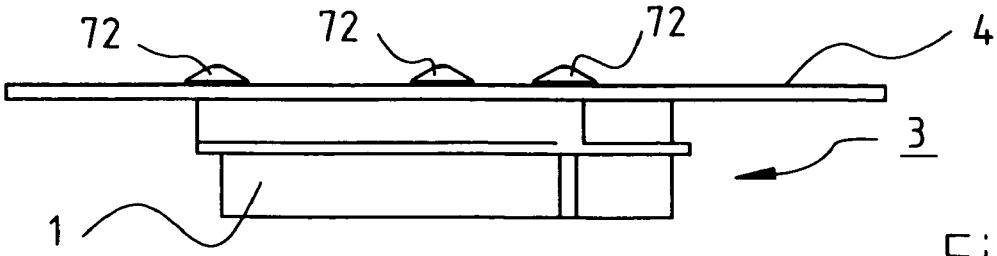
FIG. 11 is a side view of the fan, looking along direction XI of FIG. 7.

FIG. 10 is an analogous illustration, but looking from another direction, and FIG. 11 also is a side view of the mounted fan, but from still another direction.

Method of Assembling Fan and Support Structure

A preferred method of mounting elements 7 into support structure 4 is illustrated in detail in FIGS. 12 through 14.

In the example shown, the shaft 71 of a mounting element 7 has a narrowed zone 73, which could also be called a constriction, and whose length can be matched to the thickness of wall 4. By means of this construction 73, one obtains a reliable form-lock in all directions.

Channel 74 is open at a first end 75, remote from the mushroom-shaped head portion 72, and terminates at a second end 76 in the interior of head portion 72. Into channel 74, which runs parallel to the longitudinal axis of mounting element 7, a rod-shaped tool 10 is inserted, as shown in FIG. 12.

Tool 10 is inserted far enough into channel 74 that the mounting element 7 is elastically deformed in the manner shown. Thereby, its outer diameter shrinks correspondingly, and the element reduces it size particularly adjacent constriction 73.

The original diameter D1 of mushroom-shaped head portion 72 (FIG. 2) was larger than the diameter D2 of mounting hole 41 (FIG. 4; FIG. 12), but due to the elongation now has a diameter D3 (FIG. 13) which is less than the diameter D2 of fastening hole 41.

Thus, the mounting element 7 can be inserted, in the direction of an arrow 11, into mounting hole 41, as shown in FIG. 12, after which rod-shaped tool 10 is retrace or slid out of mounting element 7, in the direction of an arrow 12 (FIG. 13). Thereby, mounting element 7 elastically returns to its rest state and resumes its original form, as shown in FIG. 14, and head portion 72 of mounting element 7 is anchored form-lockingly within mounting hole 41.

The foregoing has referred to cross-sectional diameters D1, D2, D3. The mushroom-shaped head portion 72 could also be called a "cross-sectionally enlarged" region 72, since its cross-sectional surface is greater than those of the constricted zone 73 and of the shaft 71.

Naturally, many variations and modifications are possible within the scope of the invention, as will be apparent to those skilled in the art. Therefore, the present invention is not limited to the embodiments shown and described above, but rather is defined by the following claims.

What is claimed is:

1. A fan, comprising at least one mounting element (7) for mounting said fan at a mounting opening (41), said mounting element (7) being formed of an elastomeric material and being formed with a shaft portion (71) and a head portion (72), said portions cooperating, upon mounting of said fan, with said mounting opening (41) to secure said fan in position;

wherein said at least one mounting element (7) is formed with an internal channel (74) having a first end, adjacent said head portion, which is substantially closed, and a second end, remote from said head portion (72), which is open.

2. The fan of claim 1, further comprising an elastomeric coating (1) which at least partially surrounds said fan (3).

3. The fan of claim 1, wherein said mounting opening (41) is essentially circular and has a diameter (D2) which is smaller than a diameter (D1), in a rest state, of said head portion (72) of said at least one mounting element (7).

4. The fan of claim 1, wherein a plurality of mounting elements (7) are provided on said fan (3) and said mounting elements (7) all point essentially in a common direction.

5. The fan of claim 1, wherein each mounting element (7) is essentially cylindrical and said channel (74) is oriented longitudinally, said channel (74) having a clad end (76) inside said head portion (72) and an open end (75) in said shaft portion (73) remote from said head portion (72).

6. The fan of claim 1, wherein said elastomeric coating (1) is implemented for mounting along a periphery of an aperture (43) in a supporting structure (4), so that said fan (3), during operation, creates an airflow through sad aperture (43).

7. The fan of claim 1, further comprising an elastomeric coating (1) at least partially surrounding said fan (3), said coating being connected with a strain relief (6) adapted for receiving and guiding a connecting cable of said fan (3).

8. The fan of claim 1, wherein said fan is a small axial fan.

9. The fan of claim 1, wherein said fan is a small diagonal fan.

10. The fan of claim 1, wherein said fan is a small radial fan.

11. A method of mounting a fan (3) to a supporting structure (4), using at least one elastomeric mounting element (7) having an internal channel (74) and a cross sectionally enlarged portion (72), said channel (74) having a substantially closed end which, upon mounting of sad fan, is pointing toward said structure (4), and being open at its opposite end remote from said wall for insertion of a tool (10) at said open end, comprising the steps of:

inserting said tool (10) into said internal channel (74) of said at leas one mounting element (7), thereby elongating said mounting element (7) and reducing a diameter of said cross-sectionally enlarged portion (72), during elongation of said mounting element (7), inserting it into a corresponding mounting hole (41) formed in said support structure (4), and retracting said tool (10), thereby permitting said diameter of said cross-sectionally enlarged portion (72) to elastically increase sufficiently to create a secure engagement with said mounting hole (41) formed in said support structure (4).

12. The method of claim 11, wherein said step of inserting said tool comprises inserting said tool up to said substantially closed end (76) of said channel (74) in said mounting element (7).

13. The method of claim 11, wherein said step of inserting said tool comprises inserting said tool sufficiently far into said channel to elongate said mounting element (7) and, through said elongation, to reduce a diameter of said cross-sectionally enlarged portion (72).

14. The method of claim 11, wherein said step of inserting said tool comprises inserting said tool sufficiently far into said channel to reduce an initial diameter (D1) of said cross-sectionally enlarged portion (72), said reduced diameter permitting passage of said mounting element (7) into said mounting hole (41).

15. The method of claim 11, further comprising preliminary steps of forming said elastomeric mounting element(s) (7) integrally with an elastomeric coating (1) adapted to at least partially surround said fan (3), and securing said elastomeric coating (1) around said fan (3) prior to mounting said fan (3) to said support structure (4).

* * * * *

UNITED STATES PATENT AND TRADEMARK OFFICE

CERTIFICATE OF CORRECTION

PATENT NO. : 7,118,334 B2
APPLICATION NO. : 10/971648
DATED : October 10, 2006
INVENTOR(S) : Winkler et al.

It is certified that error appears in the above-identified patent and that said Letters Patent is hereby corrected as shown below:

1. In column 1, line 13 “computed” should be -- computers --
2. In column 2, line 42 “force” should be -- form -- (first occurrence)
3. In column 3, line 41 “Hereon” should be -- thereon --
4. In column 4, line 11 “retrace” should be -- retracted --
5. In column 4, line 52, claim 5, line 3 “clad” should be -- closed --
6. In column 5, line 12, claim 11, line 10 “leas” should be -- least --

Signed and Sealed this

Twelfth Day of August, 2008

JON W. DUDAS
*Director of the United States Patent and Trademark Office*